US005964383A

United States Patent [19]

Cargile

[11] Patent Number: 5,964,383

[45] Date of Patent: Oct. 12, 1999

[54] PINCH NECK POUR SPOUT CONTAINER

[75] Inventor: David W. Cargile, Lititz, Pa.

[73] Assignee: Graham Packaging Company, L.P., York, Pa.

[21] Appl. No.: 09/061,823

[22] Filed: Apr. 16, 1998

Related U.S. Application Data

[60] Provisional application No. 60/044,588, Apr. 22, 1997.

[51] Int. Cl.[6] ..... B65D 5/72

[52] U.S. Cl. ..... 222/571; 222/572

[58] Field of Search ..... 222/571, 572, 222/462, 475

[56] References Cited

U.S. PATENT DOCUMENTS

D. 314,142 1/1991 Briggs .
1,814,659 7/1931 Barroll .
2,035,877 3/1936 Geerlings .
2,059,910 11/1936 Ravenscroft .
4,079,859 3/1978 Jennings ..... 222/475
4,298,038 11/1981 Jennings ..... 222/475
4,838,464 6/1989 Briggs .
4,981,239 1/1991 Cappel et al. .
4,989,757 2/1991 Krall .
5,114,659 5/1992 Krall .
5,207,356 5/1993 Krall .

*Primary Examiner*—Philippe Derakshani
*Attorney, Agent, or Firm*—Howson and Howson

[57] ABSTRACT

A unitary blow-molded hand-held plastic container having improved pouring capability without requiring separate pour spouts is disclosed. The neck has a pair of opposed panels that are pinched inwardly below the finish of the container to afford precise control during pouring.

15 Claims, 4 Drawing Sheets

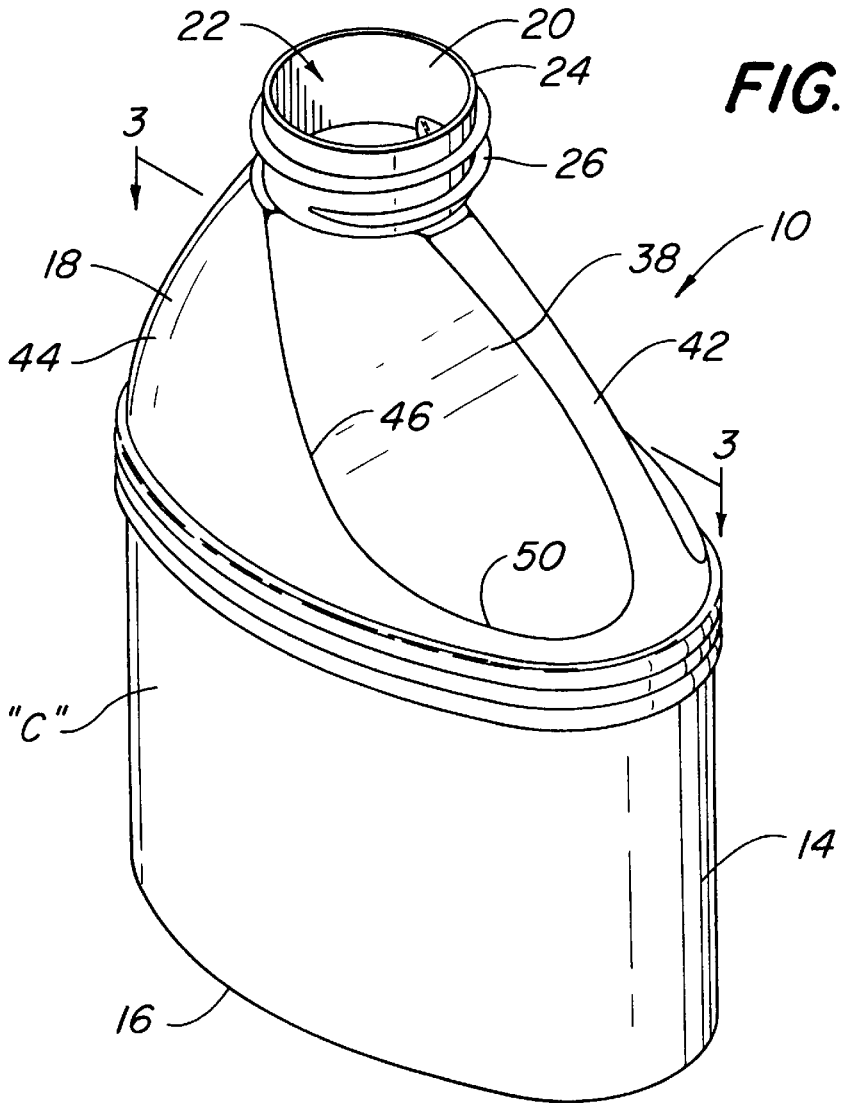
FIG. 1
FIG. 2
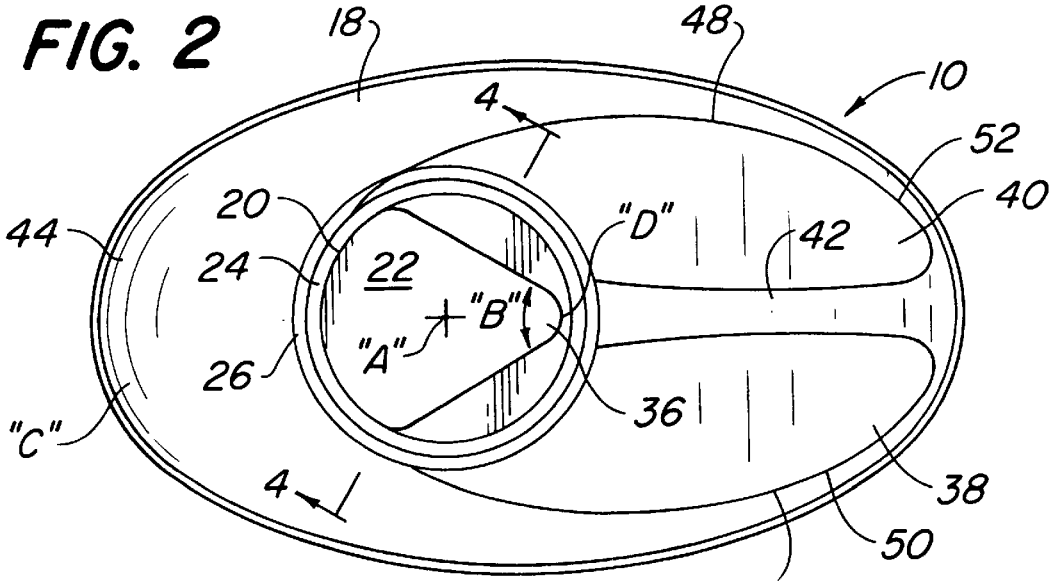

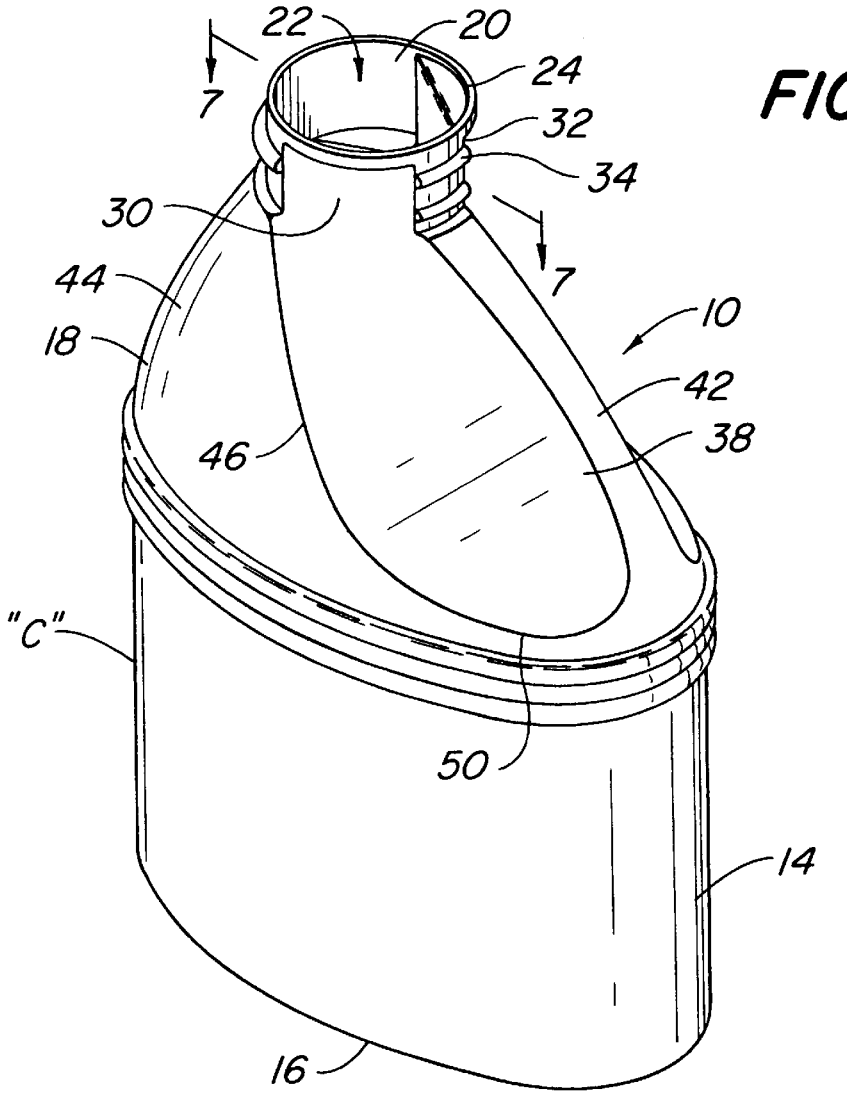
FIG. 5
FIG. 6
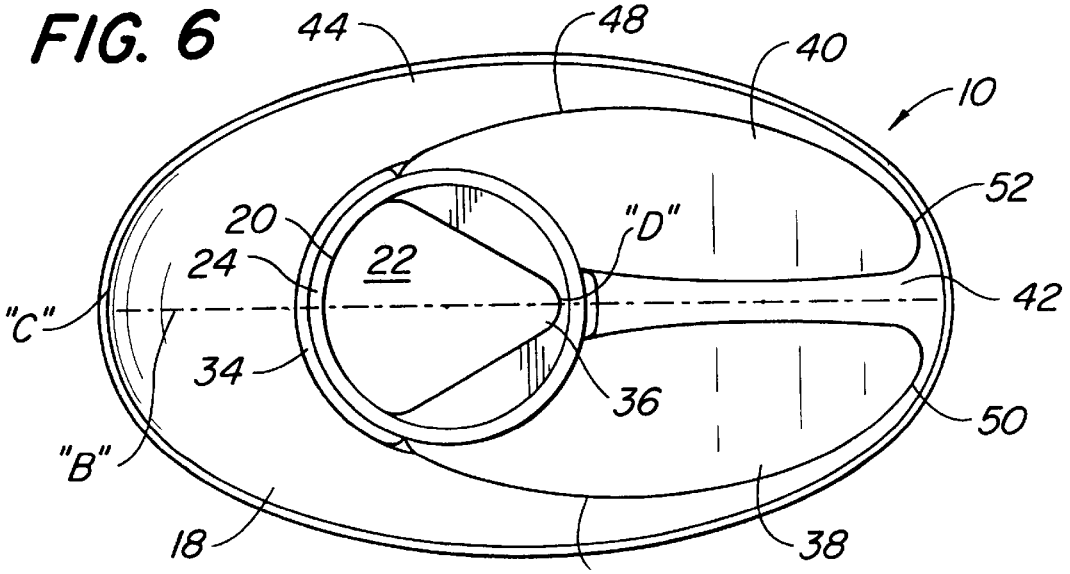

PINCH NECK POUR SPOUT CONTAINER

This Application claims benefit of Provisional Application No. 60/044,588, Apr. 22, 1997.

FIELD OF THE INVENTION

The present invention relates to a blow-molded plastic container having an integral internal pour spout for enabling a liquid to be poured in a continuous, controllable and laminar stream.

BACKGROUND OF THE INVENTION

A goal in the mass-production of blow-molded plastic containers is to provide a container structure which provides the desired functionality yet which utilizes a minimum of plastic. The container structure must be sturdy enough to withstand filling, shipping, and use. In addition, the container structure must maintain an aesthetic appearance from initial manufacture through sale and use of the container. Such plastic containers have the advantage of being completely recyclable.

Many liquid household products sold commercially are contained in blow-molded plastic containers. An example of such a product is liquid laundry detergent. Some of these detergents are sold in plastic containers having pour spouts, caps that provide measuring cups, means for providing drain back of the unused liquid from the measuring cap, and other features which provide pouring of controlled quantities of liquid from the container.

Many known blow-molded plastic container structures used in the sale of liquid household products require the use of separate injection molded parts to provide a pour spout and/or a cap having a drain back feature. For instance, U.S. Pat. No. 4,981,239 issued to Patel et al. discloses a blow-molded container having a separate injection molded cylindrical fluid retaining means to provide a drain back feature and to allow the closure to be attached to the container. Many other patents such as U.S. Pat. Nos. 2,743,844; 2,763,403; 2,848,142; 3,318,496; 3,369,710; 3,434,637; 4,128,189; 4,550,862; 4,706,829; 4,773,560; 4,830,234; and 5,188,249 each disclose a container having a separate pour spout fitted into the mouth of the container over which a separate closure is fastened.

Manufacture of these multiple part container structures utilizing known blow-molding and injection molding techniques requires the use of substantial amounts of plastic and increases the steps and complexity of producing a finished container by requiring the separate parts to be molded with precision so they can be mated. The additional plastic and required manufacturing steps increases the overall cost of manufacturing the container which is ultimately borne by the consumer.

Several expired patents disclose the use of a pour spout in the finish of a bottle without requiring the use of additional mated parts. For example, U.S. Pat. No. 1,814,659 issued to Barrol, U.S. Pat. No. 2,035,877 issued to Geerlings and U.S. Pat. No. 2,059,910 issued to Ravenscroft all disclose bottle finishes having a pouring spout formed therein. All these patents were issued before the advent of blow-molded plastic containers.

The assignee of the present application has manufactured hand-held blow-molded plastic containers having a pinched area adjacent the finish of the container for providing a venting function during pouring. See U.S. Pat. No. 4,838,464 issued to Briggs. During pouring of contents from the Briggs container, air flows through the vent passage to equalize air pressure in the container so that liquid can flow from the container in a continuous stream. The Briggs container is particularly suited for containing motor oil.

Although various ones of the referenced containers may function satisfactorily for its intended purpose, there is a need for a blow-molded plastic container having a unitary construction which provides a built-in pour spout affording controlled pouring of desired quantities of contained liquids. Such a container should also be capable of being manufactured readily utilizing conventional blow-molding equipment while requiring a minimum amount of plastic to reduce the cost of manufacture.

OBJECTS OF THE INVENTION

With the foregoing in mind, a primary object of the present invention is to provide a novel blow-molded plastic container having improved pouring capabilities enabling desired quantities of a contained liquid to be poured in a continuous and controllable stream.

Another object of the present invention is to provide an improved container structure having a unitary blow-molded body which includes a pour spout.

A further object of the present invention is to provide a unique blow-molded container which has desirable pouring capabilities without requiring separate plastic components and their concomitant manufacturing and assembly costs.

SUMMARY OF THE INVENTION

More specifically, the present invention provides a blow-molded plastic container having an internal integral pour spout. The pour spout facilitates the dispensing of the contents of the container. The container has a neck portion terminating in a finish. The finish is adapted to sealingly engage a removable closure.

The neck has a pair of inwardly convex panels that merge together along a common juncture to form a flow channel. The flow channel opens inwardly into the neck and extends to the finish. The neck panels converge in an upward direction toward the finish for defining therebetween a progressively decreasing dihedral angle as the panels approach the finish. The neck panels cooperate to form a progressively tapering pour spout inside the container to facilitate pouring of the contents.

BRIEF DESCRIPTION OF THE DRAWING

The foregoing and other objects, features and advantages of the present invention should become apparent from the following description when taken in conjunction with the accompanying drawings, in which:

FIG. 1 is a perspective view of a container embodying the present invention;

FIG. 2 is a top plan view of the container shown in FIG. 1;

FIG. 5 is a perspective view of a second embodiment of the present invention;

FIG. 6 is a top plan view of the container shown in FIG. 5;

DETAILED DESCRIPTION OF PREFERRED EMBODIMENT

Figure 3:
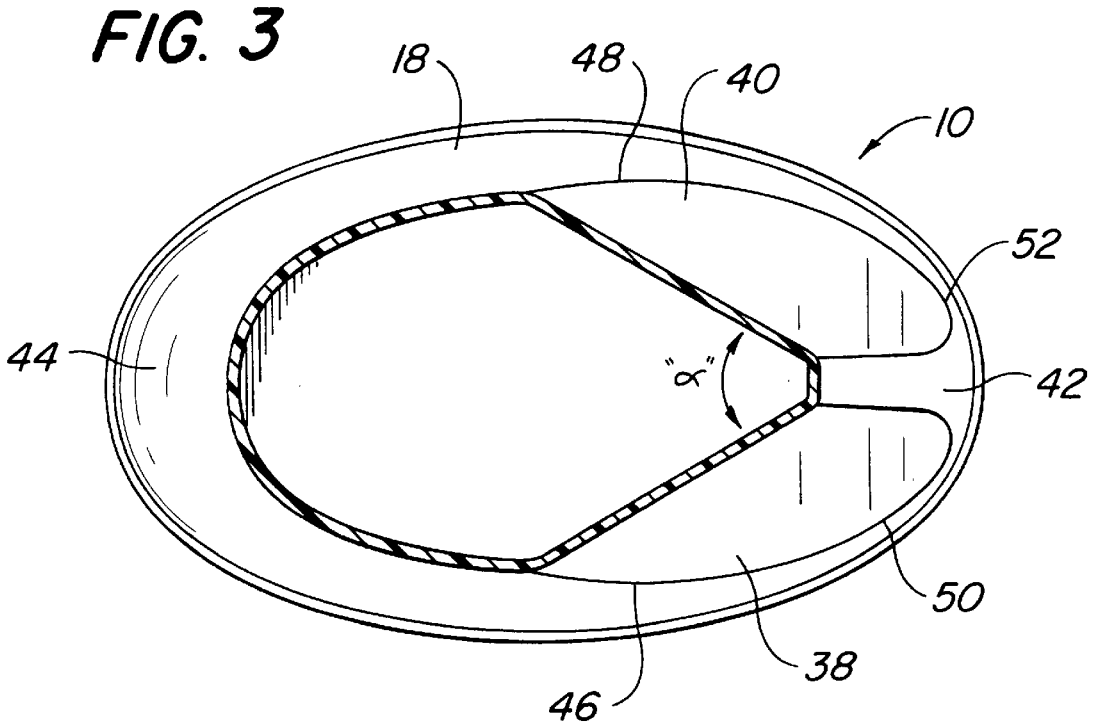
FIG. 3 is a cross-sectional plan view of FIG. 1 along plane 3—3.

Referring now to the drawings, FIG. 1 illustrates a blow molded plastic container 10 used for storing and dispensing a flowable material, such as a liquid or a powdered household detergent. The container 10 is of one-piece, unitary, blow-molded construction which requires only a conventional closure, or cap 12, to close and seal the container 10. Other than the cap 12, the container has no other parts which need to be assembled with it. Such a container may be produced in a range of sizes.

The container 10 of the present invention has certain aspects which are common to known blow-molded PET containers. For instance, the container 10 includes a body portion 14 with a base 16. The body portion 14 merges upwardly into a neck portion 18 located substantially centrally above the body portion 14. The neck portion 18 terminates upwardly into a finish 20. The finish 20 defines a circular opening 22 through which the flowable material is dispensed and is engageable with the cap 12 to seal the opening 22. As shown in FIGS. 2 and 6, the container neck and body portions, 18 and 14, have a substantially oblate transverse cross-section at least along a transverse line of juncture therebetween.

A circular top flange 24 of the finish 20 provides a no-drip pouring edge. With the prior art cited above, a container such as that shown in the Geerlings '877 patent provides a non-circular top flange. Such a flange is difficult to seal properly with a closure to ensure that the flowable material does not drip down the side of the container when the cap is installed onto the finish. The present invention utilizes a continuous circular top flange 24 in all of the embodiments so that a good seal can be obtained and unwanted dripping is prevented.

In some of the embodiments, such as illustrated in FIGS. 1–4, the finish 20 is completely cylindrical, or tubular, and has a substantially continuous peripheral helical thread 26 to cooperate with complementary threads 28 on the inside of the removable cap 12. In other embodiments, such as illustrated in FIGS. 5–8, the finish 20 has a pair of recesses, 30 and 32, and the peripheral helical threads 34 are discontinuous in the regions of the recesses. However, in all embodiments, the top flange surface 24 is formed circular to create a no-drip edge and provide a continuous circular seal against the cap 12. The flange surface 24 may be flat as shown, for cooperating with a gasket on the inside of the cap 12; or it may have a sealing flange (not shown) for use with a plain cap, such as the sealing structure disclosed in U.S. Pat. No. 5,188,249, to Cargile, assigned to the assignee of the present application.

A novel feature of the blow-molded plastic container 10 of the present invention is an internal integral pour spout 36 which facilitates dispensing of the contents of the container 10. The internal integral pour spout 36 is formed by the neck 18 of the container 10. To this end, the neck 18 has a pair of inwardly convex panels, 38 and 40, that merge together along a common juncture to form a flow channel 42. The flow channel 42 opens inwardly into the neck 18 along its entire length and extends to the finish 20. As shown in FIGS. 1 and 5, the flow channel 42 is convex outwardly of the neck 18 below the finish 20.

The panels 38 and 40 are pinched, or formed, inwardly to define opposite sides of the neck 18. The neck 18 has a peripheral wall portion 44 extending around the finish 20 and connecting the panels 38 and 40 along lines of inflection 46 and 48 remote from the flow channel 42. The flow channel 42 merges with the finish 20 at one location, location "D", and the lines of inflection 46 and 48 merge with the finish 20 opposite location "D".

The circular top flange 24 of the finish 20 defines an imaginary elongate vertical cylinder, or tube, having a central axis "A" (FIG. 2) which extends lengthwise, or longitudinally, through the container body 14. The imaginary tube is completely offset inwardly from the periphery of the container body portion 14. As best seen in FIG. 6, the panels 38 and 40 are inwardly convex on opposite sides of the container body 14 and are mirror images of one another along axis "B" which lies in the plane of the parting line of the mold forming the container 10. The panels extend partially through the imaginary vertical cylinder below the finish 20. The panels 38 and 40 converge in an upward direction toward the finish 20 to define therebetween a progressively decreasing dihedral angle as they approach the finish 20.

The panels 38 and 40 as configured cooperate to provide a pour spout 36 inside the container 10 to facilitate pouring of its contents. A bottom portion 50 and 52 of each panel 38 and 40 merges into the container body 14. From the bottom portion of the panel, each panel 38 and 40 extends inwardly toward the imaginary cylinder, and into it toward their upper portion. Also, from the bottom portion of the panels, each panel 38 and 40 extends horizontally toward the flow channel 42 to define the pour spout 36. Progressive transverse cross-sections of the neck 18 illustrate that the panels 38 and 40 define a "V"-shaped configuration. See FIGS. 2 and 3. This "V"-shaped configuration is relatively broad adjacent the container body 14, and narrows adjacent the finish 20 to direct the flowable material in a controllable stream toward the top flange 24 when the container 10 is tilted into a dispensing position. Compare angle $\alpha$ FIG. 3 with angle $\beta$ in FIG. 2.

Figure 4:
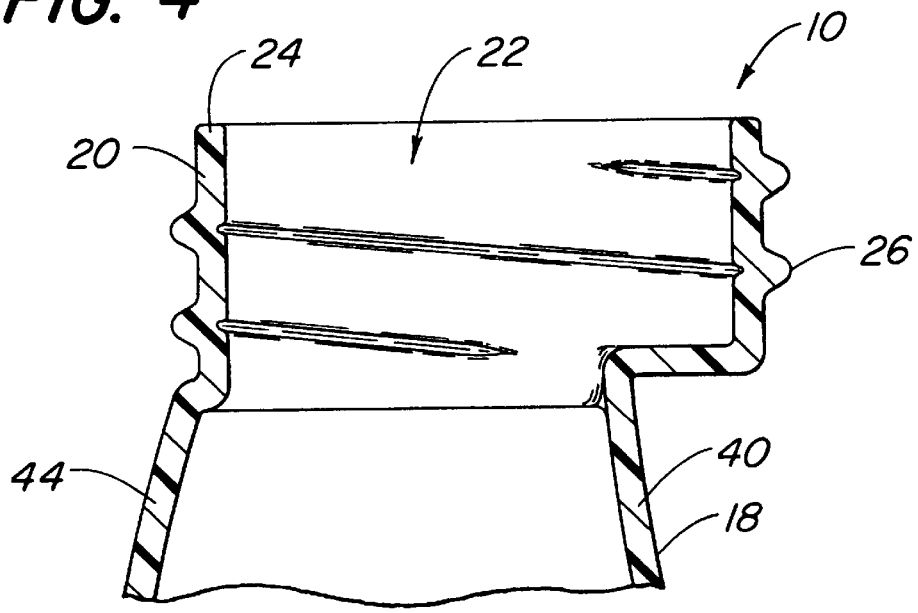
FIG. 4 is a cross-sectional view of the finish of the container in FIG. 2 taken along plane 4—4.
Figure 7:
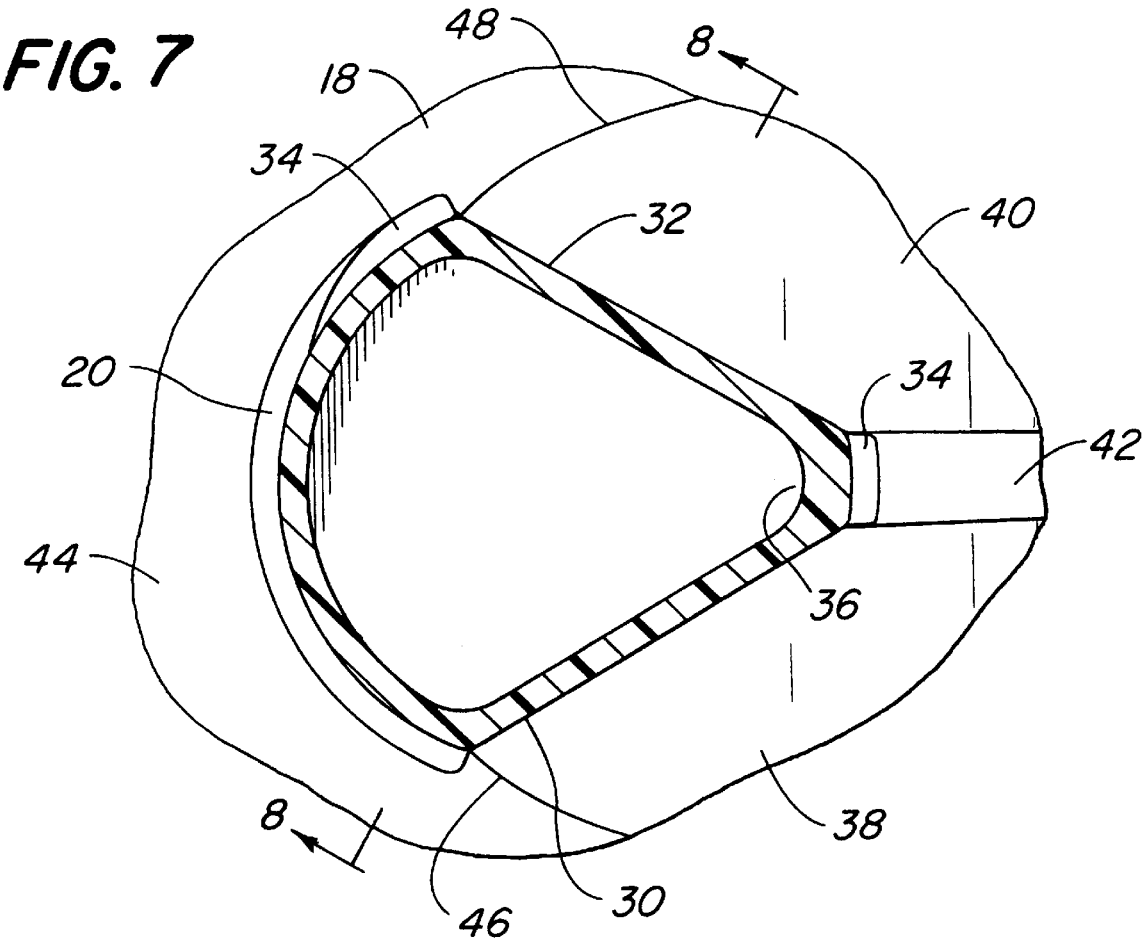
FIG. 7 is a cross-sectional plan view of FIG. 5 along plane 7—7.
Figure 8:
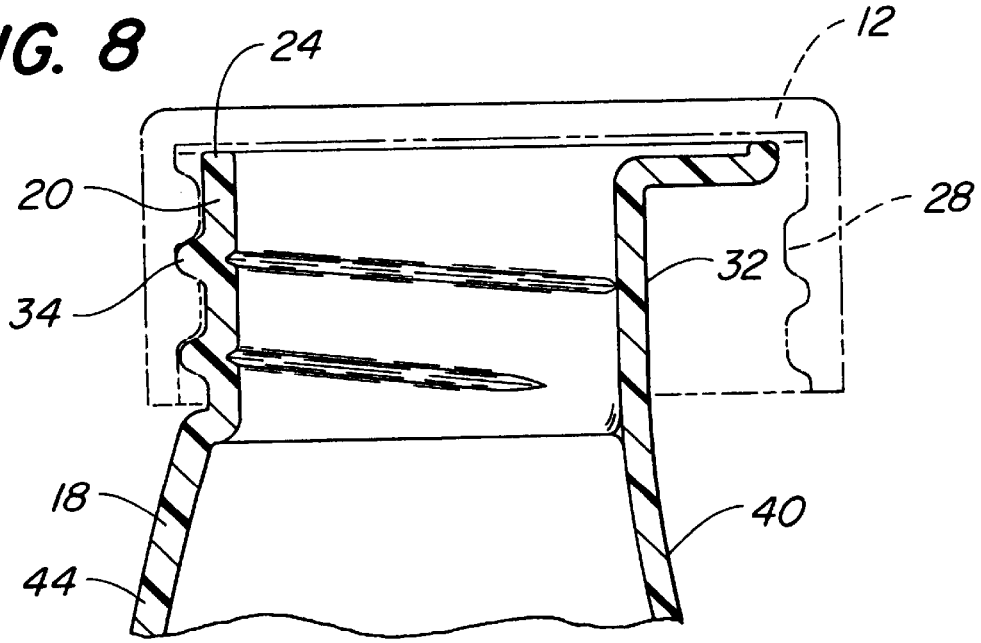
FIG. 8 is a cross-sectional view of the finish of the container in FIG. 6 taken along plane 8—8 and with a cap shown in phantom.

A vertical cross-section through the container neck 18 as seen in FIG. 4 illustrates that the pair of panels 38 and 40 provide a partial funnel-like configuration to direct the flowable material toward the pouring spout location on the top flange 24 and through the opening. Thus, the panels 38 and 40 cause the flowable material to flow either outward toward the flow channel 42, or inward toward the remaining flowable material contained within the body 14 of the container 10, depending on the tilt of the container 10.

In use, a consumer grasps the container 10 along the container neck 18 at location "C" opposite the pair of panels 38 and 40. Grip panels (not shown) may be formed into the container body at this location. The container 10 is tilted into a dispensing position with location "D" of the circular top flange 24 being lowered a sufficient amount such that the liquid begins exiting through the opening at location "D". When the consumer is finished pouring the desired amount of liquid, the container 10 is tilted back into an upright position.

The configuration of the container 10 allows an accurate and precise amount of liquid to be dispensed from the container 10, and the user is able to cut off the flow of liquid in a precise manner.

The above container is particularly suited for manufacture by blow-molding techniques. A preferred material for the container body is HDPE/PP.

While the preferred embodiment of the present invention has been described in detail, various modifications, alterations, and changes may be made without departing from the spirit and scope of the present invention as defined in the appended claims.

I claim:

1. A blow-molded plastic container having an internal integral pour spout to facilitate dispensing of contents from the container, said container having a neck portion terminating in a finish adapted to sealingly engage a removable closure, said neck having a pair of inwardly convex panels that merge together along a common juncture to form a flow channel opening inwardly into said neck and extending to said finish, said neck panels converging in an upward direction toward said finish for defining therebetween a progressively decreasing dihedral angle as they approach said neck finish, whereby said neck panels cooperate to form a progressively tapering pour spout inside the container to facilitate pouring of the contents.

2. A container according to claim 1 wherein said container has a body portion below said neck portion, and said neck finish is located substantially centrally above said body portion.

3. A container according to claim 1 where said finish has a continuous circular sealing surface for sealingly engaging the interior of said removable closure.

4. A container according to claim 1 wherein said channel is open inwardly along its entire length into said container neck portion.

5. A container according to claim 1 wherein said neck has a peripheral wall portion extending around said finish and connecting said neck panels along lines of inflection remote from the channel formed by said neck panels, said channel merging with said finish at one location and said lines of inflection merging with said finish on opposite sides of said one location.

6. A container according to claim 1 wherein said finish is tubular and has substantially continuous peripheral helical threads for threadedly engaging said removable closure.

7. A container according to claim 1 wherein said finish has a pair of recesses on opposite sides of said flow channel and has peripheral helical threads that are discontinuous in the regions of said pair of recesses.

8. A container according to claim 1 wherein said channel is convex outwardly of said neck below said finish.

9. A container according to claim 1 wherein said finish is tubular and defines an imaginary elongate tube extending longitudinally into the container, and said neck panels extend into said imaginary tube below said finish.

10. In a blow-molded plastic container having a body portion for containing a flowable material, a finish for dispensing the flowable material, and a neck portion merging the body portion to the finish, the improvement wherein said neck portion comprises a pair of inwardly convex panels forming therebetween an inwardly-open flow channel extending along a common line of juncture of said panels, said flow channel being convex outwardly of said neck and merging into said finish at one interior peripheral location thereof, said neck panels cooperating with said flow channel to define a continuously progressively decreasing dihedral angle in a direction from said container body toward said finish for directing flowable material through said finish, said finish having a circular sealing surface for sealingly engaging a removable closure, said circular sealing surface defining an imaginary elongate tube extending longitudinally therebelow with said neck panels extending into said imaginary tube adjacent said finish, said imaginary tube being completely offset inwardly from the periphery of said container body portion.

11. A container according to claim 10 wherein said finish is tubular and has a substantially continuous helical thread extending about its outer periphery.

12. A container according to claim 10 wherein said finish has a pair of recesses located below its circular sealing surface and a helical thread which is discontinuous in the regions of said recesses.

13. A container according to claim 10 wherein said flow channel is open inwardly continuously along its length and extends along a substantial portion of said neck.

14. A container according to claim 10 wherein said neck panels extend upwardly into the finish and define a pair of recesses therein on opposite sides of said flow channel.

15. A blow-molded plastic container for storing and dispensing a flowable material, the container having a finish and a neck connecting the finish to a container body, the finish defining an opening for dispensing the flowable material and engageable with a removable closure for sealing the opening, the improvement wherein the finish has a circular top flange providing a no-drip pouring edge, said top flange defining an imaginary elongate cylindrical tube extending vertically through the container body; the container neck having a pair of panels formed therein on opposite sides thereof, each of said panels extending inwardly into the neck and partially into said imaginary tube; said pair of panels converging in both a horizontal and a vertical direction toward the opening so that both transverse and longitudinal cross-sections through the neck define a "V"-shaped configuration which functions as an internal pour spout for directing the flowable material toward said opening.

* * * * *